US005188567A

United States Patent [19]

Volkov

[11] Patent Number: 5,188,567

[45] Date of Patent: Feb. 23, 1993

[54] RACETRACK

[76] Inventor: Eduard Volkov, 147 N. Broad St., Trenton, N.J. 08608

[21] Appl. No.: 744,289

[22] Filed: Aug. 13, 1991

[51] Int. Cl.[5] ..... A63K 1/00

[52] U.S. Cl. ..... 472/85

[58] Field of Search ..... 472/85-87

[56] References Cited

U.S. PATENT DOCUMENTS 809,588 1/1906 Thomas et al. ..... 472/85
2,146,631 2/1939 Kish ..... 472/85
2,180,476 11/1939 Molinare ..... 472/86
3,203,396 8/1965 Carmichael, Jr. ..... 472/86 X

*Primary Examiner*—Richard E. Chilcot, Jr.
*Attorney, Agent, or Firm*—Watov & Kipnes

[57] ABSTRACT

A racetrack includes a substantially circular outer track, a centrally located staging and finish area, and a plurality of substantially radially aligned juxtaposed racing lanes extending from within the centrally located area to the outer track. Racers race between the centrally located area and the outer track on the lanes, and about the outer track for a given number of laps.

19 Claims, 4 Drawing Sheets

RACETRACK

FIELD OF THE INVENTION

The field of the present invention relates generally to racetracks, and more particularly to multi-purpose racetracks.

BACKGROUND OF THE INVENTION

Racetracks are typically circular in design and may include a plurality of concentric circular lanes, depending upon the type of race to be run on the track. Foot races, skating races, car races, horse races, dog races, bicycle races, motorcycle races, and so forth are all typically run on a circular-type track. The present inventor recognized that by redesigning the track audience or fan participation and interest can be heightened.

SUMMARY OF THE INVENTION

An object of the invention is to provide an improved multi-purpose racetrack.

Another object of the invention is to provide an improved racetrack for motorcycle and/or auto racing.

Yet another object of the invention is to provide an improved racetrack for other kinds of racing, such as horse racing, dog racing, foot racing and so forth.

Yet another object of the invention is to provide an improved racetrack for bicycle racing.

Another object of the invention is to provide an improved racetrack for increasing audience or fan interest and enthusiasm relative to the races.

With these and other objects in mind, the present invention includes a circular racetrack having a centrally located display means for showing race results, the status of ongoing races, racers assigned to various lanes, and so forth; an innermost starting area concentric with the centrally located display means including a plurality of radially directed and juxtaposed lanes for each racer; a plurality of starting gates associated with each lane, respectively, forming an outer circumference for the starting area; and the radially directed lanes each entering into an outer most circular track for receiving racers from the radial lanes, permitting the racers to continue racing one or more laps about the circular track, before re-entering their respective lanes, for racing back down such respective lanes to cross a finish line located close to or within the centrally located starting area. One or more circular jumps or hazards can be located between the inner circular starting area and the outermost circular track, with such jumps or barriers forming a circle concentric with the aforesaid starting area and track, and with one another where more than one barrier or jump is included. In an embodiment of the invention for providing the racetrack configured for motorcycle racing, the track is typically be a dirt track, with used tires embedded in the dirt for separating the radially oriented lanes, and the outer circumference of the outermost circular track, for providing safety barriers.

BRIEF DESCRIPTION OF THE DRAWINGS

Various embodiments of the present invention are illustrated and described herein with reference to the accompanying drawings, in which like items are identified by the same reference designation, wherein.

DETAILED DESCRIPTION OF THE DRAWINGS

Figure 1:
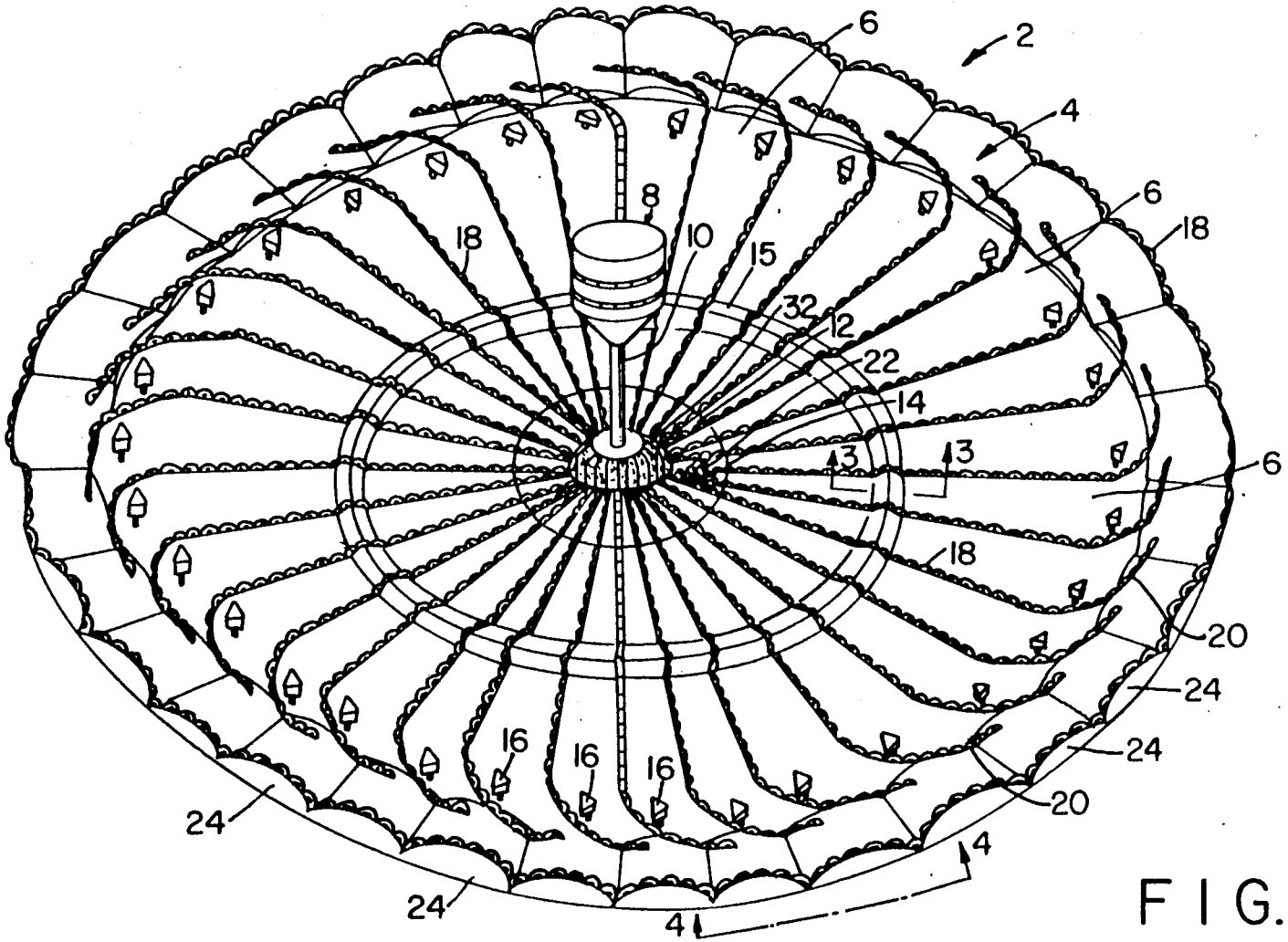
FIG. 1 is a pictorial diagram of a racetrack of one embodiment of the invention.
Figure 2:
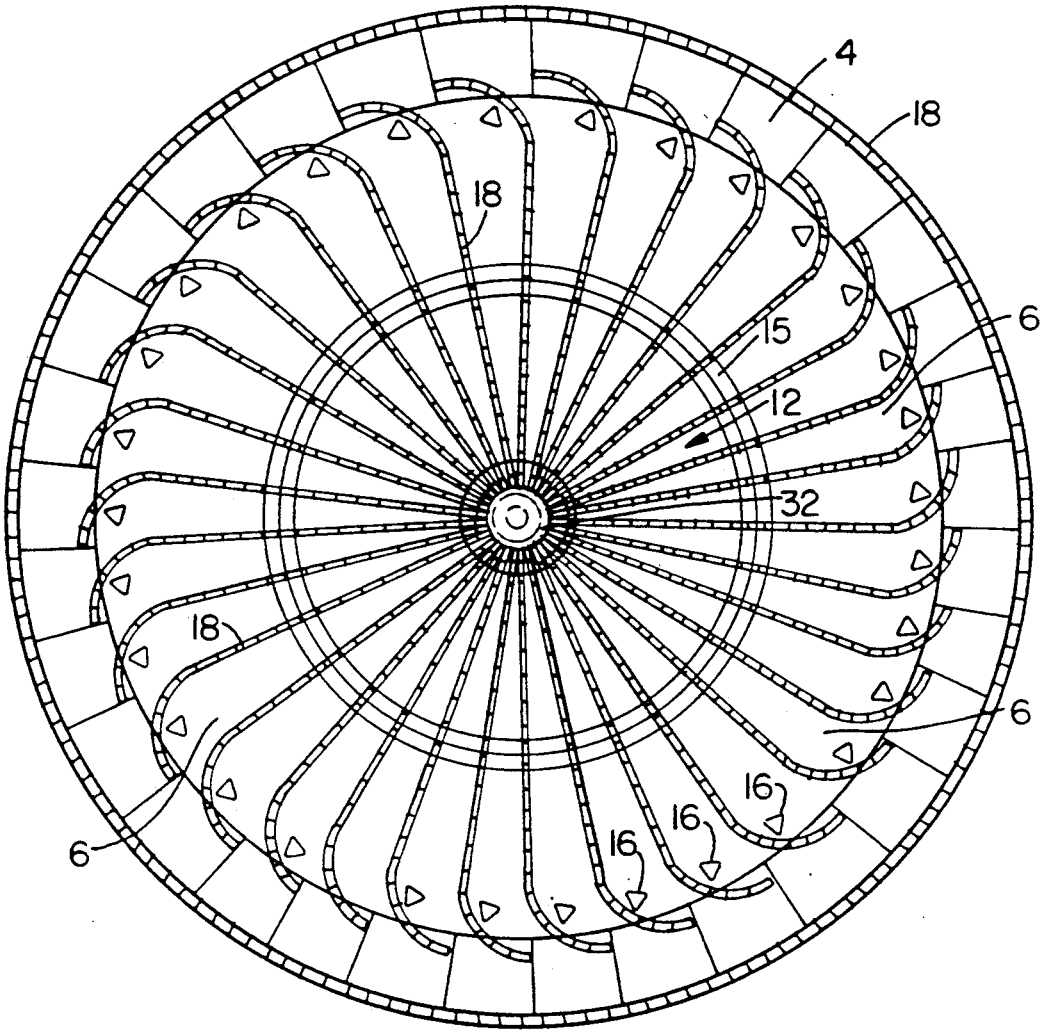
FIG. 2 is a top view of the embodiment of the invention of FIG. 1.

With reference to FIGS. 1 and 2, one embodiment of the invention is shown specifically configured for motorcycle, auto, or bicycle racing, for example. As shown, a generally circular racetrack 2 includes an outermost circular track 4, and a plurality of radially directed lanes 6 typically juxtaposed to one another and of a selected number. In this example, thirty-two juxtaposed radially oriented lanes 6 are shown, but this number is not meant to be limiting, in that a lesser or greater number of lanes 6 may be utilized depending upon the size of the track and the type of race to be run on the track. For example, a horse race would typically require wider radial lanes 6, and a wider outer circumferential track 4 than a track configured for human racers using the basic embodiment of the present invention.

A centrally located display 8 is included for showing lane assignments, race results, starting times, advertising media, and so forth. The display 8 is shown as a circular display mounted on a pole 10. Other types of displays may be used, and the display 8 shown is not meant to be limiting. Many known displays have been developed for use in arenas, racetracks, and so forth, that could be applied for use as display 8.

A very basic configuration for an embodiment of the invention providing a track for human racing may only include the radially oriented lanes 6 leading to the outermost circular track 4. In such a configuration, runners would start within a starting area such as inner circular area 12, and would begin the race off of starting blocks (not shown per se) arranged to form a circle 14. Each one of the lanes 6 would be assigned a unique number, and the number would be posted on a lane number display 16 located at the end of the lane proximate the outer track 4, as shown. The runners would start the race from the circular area 12, run down their designated lane onto the outer track 4, and around the outer track 4 in a clockwise or counter-clockwise direction, primarily depending on how the ingress and egress of the lanes 6 are directed relative to the outer track 4. In the example of FIG. 1, the lanes 6 are configured for having the runners enter the circular track 4 and run in a counter-clockwise direction, for example. The lanes 6 could be otherwise configured for having the runners run in a clockwise direction around the outer track 4. When the runners complete a given number of laps on track 4, they then return to their respective lanes 6, and run back down their lanes to cross over a finish line preferably associated with circular area 12. For example, the finish line can be coincident with the starting line 14. The runner with the shortest time in completing the designated race would be the winner. Several races can be run using alternate or designated ones of the lanes 6 for each race, or a race can be run with racers associated with all of the lanes 6, with an endless variety of different combinations of racing being possible with the configuration of the track 2. Any racing formulas or rules given herein as examples are not meant to be limiting. Also shown in this example is a circular obstacle, ramp, or hurdle 16 that can be included concentric with the starting area 12, and between starting area 12 and the outer track 4. As discussed in greater detail below, a plurality of such obstacles or hurdles or ramps 16, for example, can be located in a concentric manner and spaced apart between the starting area 12 and outer track 4 in each lane 6, but are not shown in FIG. 1 for sake of simplicity.

The embodiment of FIG. 1 is specifically configured to provide a motorcycle, bicycle or automobile racetrack, for example. In this embodiment a plurality of tires 18 are embedded in the track to form the radial spokes or sides of each one on the lanes 6 from within the starting area 12 extending outward into the track 4, as shown. The tires 18 provide a dual function of both serving as crash barriers and as lane separators. Note that in the example shown, the tires 18 for a given lane 6 are arranged to form outermost arc-like sections 20 for directing a given lane 6 onto the outer track 4, as shown.

Figure 3:
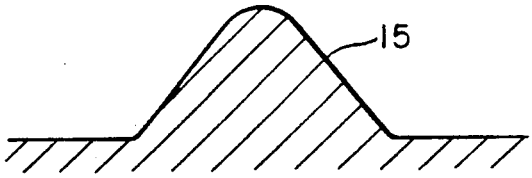
FIG. 3 is a cross sectional view of a circular ramp or jump taken along section 3—3 of FIG. 1, for one embodiment of the invention.

In this example, the barrier 15 serves to provide a ramp, as shown in cross section along 3—3 in FIG. 3. The ramp 16 causes the motorcycle or bicycle racers 22 to become airborne while racing in their respective lanes 6 from the starting area 12 to outer track 4, and in returning from outer track 4 to the starting or finish area 12. In this manner, added excitement is provided for the audience or fans, and increased skill is required of the motorcycle or bicycle racer 22.

Figure 4:
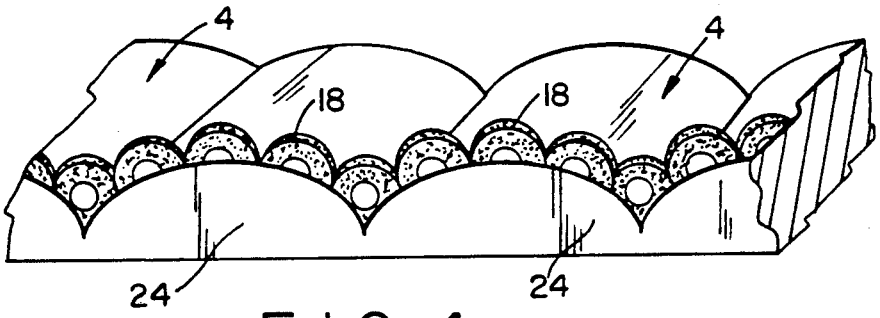
FIG. 4 is a partial enlarged pictorial view looking in along section 4—4 from outside the circumferential edge of the outer circular track of one embodiment of the invention.

For motorcycle racing, for example, the outer track 4 can be configured in an undulating pattern formed by juxtaposed ramps 24, as shown in this example. Note also, in the example given, that used automobile tires 18 are also embedded about the outer circumference of the outer track 4 to provide crash barriers and designate the outer circumference of outer track 4. FIG. 4 shows a enlargement of area 4—4 of FIG. 1, looking in at the outer edge of that section of outer track 4. In other embodiments of the invention, depending upon desired racing conditions, the outer track 4 can be made flat, contoured, and so forth as desired.

Figure 5:
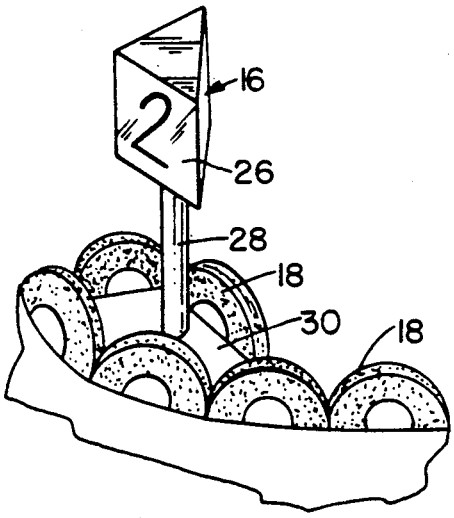
FIG. 5 is an enlarged pictorial view of a lane marker sign for one embodiment of the invention.

With reference to FIG. 5, an enlarged pictorial close-up view of the configuration of a lane marker 16 is shown. In this example, the lane marker 16 includes a three-faced triangular lane designation display 26 mounted upon a collapsible pole 28, with the other end of the pole 28 being embedded in a base member 30 surrounded by tires 18 for providing a crash or safety barrier to protect racers using the track.

Figure 7:
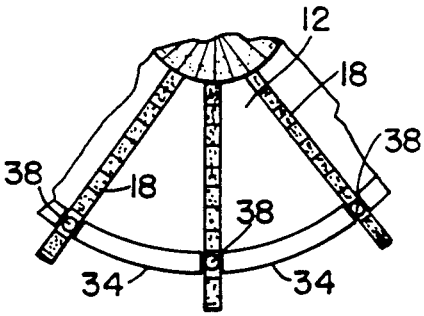
FIG. 7 is a partial top view of the embodiment of the invention of FIG. 6.
Figure 6:
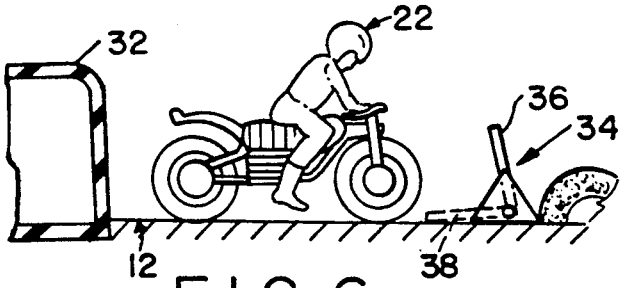
FIG. 6 is an enlarged pictorial view showing a starting area and associated starting gate for a given lane for one embodiment of the invention.

A circular crash barrier 32 is located at the center of the track 2 surrounding the pole 10, in this example, for protecting racer 22 returning to the finish area 12. As shown in FIG. 6, with regard to the example of motorcycle or bicycle racing, riders 22 begin the race within starting area 12 when a starting gate or barrier 34 is operated for dropping a blocking member 36 from an upright position as shown to a downward position as shown by gate 38 in phantom, for permitting rider 22 to drive over the lower gate 38 to begin the race. Such a starting gate 34 is known in the art. For different types of racing, other known starting gates can be utilized. With reference to FIG. 7, a top view of a portion of the starting area 12 for one embodiment of the invention is shown, including the starting gate 34 mounted between supports 38, as shown.

Figure 8:
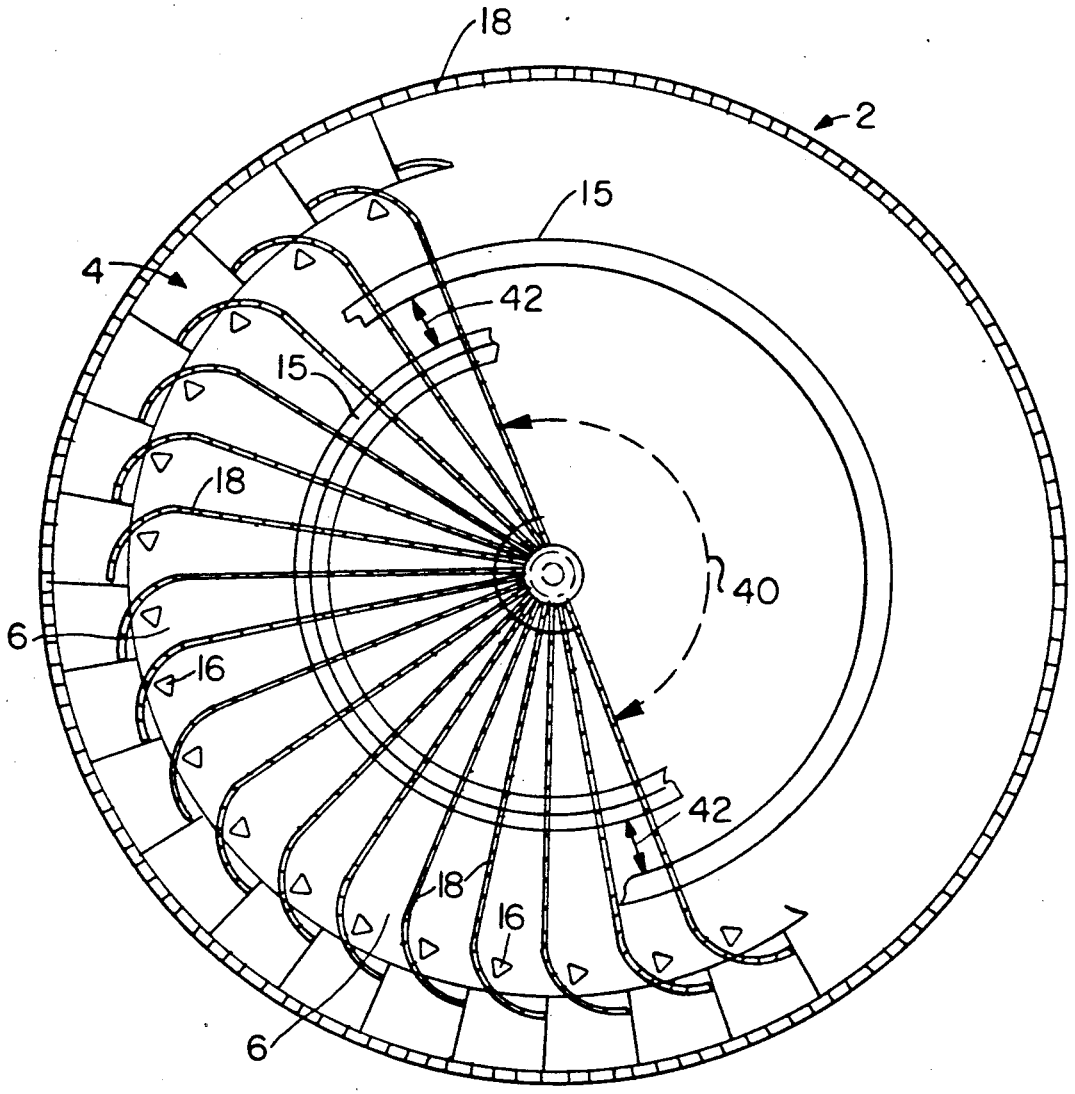
FIG. 8 is a top view of a racetrack of another embodiment of the invention.

With reference to FIG. 8, in another embodiment of the racetrack invention as indicated by the phantom arrow arc-like line 40, any desired number of radially directed lanes 6 can be provided in a given racetrack configuration. Also, depending upon the use for the racetrack, in other embodiments of the invention, any number of ramps, barriers, or hurtles 15 as designated by phantom arrow 42 can be installed in the track in concentric circles, as shown, up to a practical limit.

Although the various embodiments of the invention have been more particularly illustrated relative to use of the present racetrack for motorcycle or bicycle racing, in other embodiments of the invention the tires 18 can be eliminated, the outer circular track 4 can be flattened or banked, and the track used for human foot racing. In such an alternative configuration or embodiment, a selected number of hurtles 15 can be added for including high and/or low hurtles as a greater challenge to the racers. Similarly, appropriate safety barriers or lane dividers can be added for configuring the present racetrack in another embodiment of the invention for dog racing, ice skate racing, roller skate racing, auto racing, and so forth.

Various methods of racing for different embodiments of the invention have been briefly discussed above. For purposes of illustration, a typical motorcycle race on the track as illustrated in FIGS. 1 through 7, will now be described in greater detail. The motorcycle racers 22 begin the race by lining up as shown in their respective lanes 6 within the starting area 12 behind their respective starting gate 34. The race begins with the dropping of the starting gates from their upright positions 36 to their downwardmost positions 38, whereby the motorcycle racers 22 proceed to race down their respective lanes 6, and enter onto the outer track 4 as quickly as possible. As previously mentioned, the used tires 18 are arranged for dividing the lanes 6, and providing arc-like lead-in sections 20 for enhancing the safety of racers 22, and guiding them onto the outer track 24. The racers then proceed to race for one or more laps around the outer circular track 4. Note that the circular track 4 ca be banked. After completing the required number of laps the racers 22 then turn back into their respective lanes 6 and race down to the finish line, typically located at the outer circumference of the starting area 12. For racers who lose control or are unable stop before barrier 32, barrier 32 is designed for absorbing the impact of racers who crash into the barrier 32. For motorcycle racing, the crash barrier 32 can be constructed from safety nets in combination with other proven safety barrier materials to provide maximum protection to the motorcycle racers. When a motorcycle racer crosses the finish line, electrical sensors (not shown) provide signals to the display 8, for displaying the elapsed time and place of the racer 22 in the race. Note that in racing up and down their respective lanes 6, the motorcycle racers must jump at least one ramp 15 in heading towards the outer track 4, and on their return trip to the finish area 12 must also jump over the ramp 15. All of this adds excitement to the race, and demands extraordinary skills from the racers 22. The track can be modified for including additional concentrically located ramps 15, or the ramps can be eliminated for racing by less skilled racers 22.

Various embodiments of the invention as shown and described herein are given for purpose of illustration only, and are not meant to be limiting. Various modifications of the embodiments shown and described may be recognized by those of skill in the art, which modifications are meant to be covered by the spirit and scope of the appended claims. For example, the size of the racetrack 2, the relative size of the lanes 6, and so forth can be altered depending upon the type of race to be run on the racetrack, the speeds desired for running a race, and so forth. Also, the centrally located status display 8 can be designed to slowly turn either through electronic display means in changing the display observed at any given point in a circular manner, or the display can be physically turned. Such electronically simulated or physically adapted turning of the display 8 might be utilized during the assignment of lanes for each rider before a given race. Also, the various embodiments of the invention can be miniaturized to provide a toy or model racing track for children, and model car enthusiasts, for example. Also, an electronic finish line can be provided around the circumference of the starting area 12 for interacting with the display 8 to signal the return of racers and placement in the race, all automatically, with the instantaneous showing of elapsed times for each racer.

What is claimed is:

1. A multi-event racetrack, comprising:
a substantially circular outer track;
a substantially circular centrally located area; and
a plurality of substantially radially aligned juxtaposed racing lanes extending from within said centrally located area to said outer track for permitting racers to race between said centrally located area, said lanes, and said outer track, each racer being assigned a particular one of said lanes.

2. The racetrack of claim 1, further including at least one obstacle means in each of said plurality of lanes for a racer to overcome in racing on a respective lane to and from said centrally located area and said outer track.

3. The racetrack of claim 2, wherein said obstacle means in each of said lanes are arranged in a circle concentric with said centrally located area and said outer track.

4. The racetrack of claim 2, further including a plurality of said obstacle means spaced apart from one another in each of said lanes.

5. The racetrack of claim 4, wherein said plurality of obstacle means are each juxtaposed to a like positioned obstacle means in an adjacent lane on either side of a given lane.

6. The racetrack of claim 4, wherein said plurality of obstacle means are arranged to form a plurality of concentric circles between said centrally located area and said outer track.

7. The racetrack of claim 1, further including at the center of said centrally located area display means for displaying to race fans watching a race run on said track, information associated with the race.

8. The racetrack of claim 2, wherein said obstacle means includes a ramp.

9. The racetrack of claim 2, wherein said obstacle means includes a hurdle.

10. The racetrack of claim 1, further including crash barrier means separating said lanes for keeping racers within said lanes, respectively, and protecting racers from injury or damage.

11. The racetrack of claim 1, further including crash barrier means around the outer circumference of said outer track for protecting racers.

12. The racetrack of claim 1, further including a crash barrier means in the center portion of said centrally located area.

13. The racetrack of claim 1 further including:
first crash barrier means at the center of said centrally located area for protecting racers;
second crash barrier means separating said lanes for protecting racers; and
third crash barrier means around the outer track for protecting racers.

14. The racetrack of claim 13, wherein said second and third crash barrier means each include a plurality of automotive vehicle tires.

15. The racetrack of claim 1, wherein said outer track is configured in an undulating manner.

16. The racetrack of claim 1, further including a plurality of lane markers located at the ends of each of said plurality of racing lanes proximate said outer track, respectively, for showing lane numbers, respectively.

17. The racetrack of claim 1, wherein said outer track includes successive juxtaposed semicircular segments with juxtaposed arc-like portions joined to form the inner and outer circumference of said outer track.

18. A multi-event racetrack, comprising:
a substantially circular outer track;
a substantially circular centrally located area;
a plurality of substantially radially aligned juxtaposed racing lanes extending from within said centrally located area to said outer track for permitting racers to race between said centrally located area, said lanes, and said outer track, each racer being assigned a particular one of said lanes; and
at least one obstacle means in each lane for a racer to overcome in racing in a respective lane to and from said centrally located area and said outer track.

19. A multi-event racetrack, comprising:
a substantially circular outer track;
a substantially circular centrally located area;
a plurality of substantially radially aligned juxtaposed racing lanes extending from within said centrally located area to said outer track for permitting racers to race between said centrally located area, said lanes, and said outer track, each racer being assigned a particular one of said lanes; and
a plurality of spaced apart obstacles in each of said plurality of lanes, respectively, arranged to form concentric circles of said obstacles between said centrally located area and said outer track.

* * * * *